US006857885B2

(12) United States Patent
Pade et al.

(10) Patent No.: US 6,857,885 B2
(45) Date of Patent: Feb. 22, 2005

(54) CABLE FROM CONNECTOR COMPRISING A COMPACT LOCKING ELEMENT IN A VIBRATION-PROOF AND WATER-TIGHT DESIGN

(75) Inventors: Wolfgang Pade, Illingen (DE); Werner Hofmeister, Muehlacker (DE)

(73) Assignee: Robert Bosch GmbH, Stuttgart (DE)

( * ) Notice: Subject to any disclaimer, the term of this patent is extended or adjusted under 35 U.S.C. 154(b) by 74 days.

(21) Appl. No.: 10/311,053

(22) PCT Filed: Apr. 12, 2002

(86) PCT No.: PCT/DE02/01366

§ 371 (c)(1),
(2), (4) Date: Mar. 20, 2003

(87) PCT Pub. No.: WO02/087027

PCT Pub. Date: Oct. 31, 2002

(65) Prior Publication Data

US 2003/0166350 A1 Sep. 4, 2003

(30) Foreign Application Priority Data

Apr. 19, 2001 (DE) ..... 201 06 746 U

(51) Int. Cl.[7] ..... H01R 13/62
(52) U.S. Cl. ..... 439/157; 439/352

(58) Field of Search ..... 439/157, 352, 439/347, 152, 153

(56) References Cited

U.S. PATENT DOCUMENTS

| | | | | |
|---|---|---|---|---|
| 5,350,313 A | * | 9/1994 | Woller | 439/347 |
| 5,967,809 A | * | 10/1999 | Fink et al. | 439/157 |
| 6,305,957 B1 | * | 10/2001 | Fink et al. | 439/157 |
| 6,345,995 B1 | * | 2/2002 | Bigotto et al. | 439/157 |
| 6,382,992 B1 | * | 5/2002 | Bouchan et al. | 439/157 |
| 6,699,051 B2 | * | 3/2004 | Hofmeister et al. | 439/157 |

FOREIGN PATENT DOCUMENTS

| | | |
|---|---|---|
| DE | 196 02 293 | 7/1997 |
| DE | 199 41 806 | 3/2000 |
| EP | 0 933 836 | 8/1999 |

* cited by examiner

*Primary Examiner*—Michael C. Zarroli
(74) *Attorney, Agent, or Firm*—Kenyon & Kenyon

(57) ABSTRACT

In wiring harness connectors the function of the locking prong is integrated into the cover of the wiring harness connection that is placed on the connector housing, in such a way as to combine the cover and the further locking unit. The cover and the second locking system are configured as an integral part. Provision is also made for positioning cable outlets on both end faces of the connector.

6 Claims, 3 Drawing Sheets

CABLE FROM CONNECTOR COMPRISING A COMPACT LOCKING ELEMENT IN A VIBRATION-PROOF AND WATER-TIGHT DESIGN

FIELD OF THE INVENTION

The present invention is directed to an electrical plug connection with a connector housing having a connector that has a cover and is detachably coupled to a mating connector, the connector having a first locking system in the form of a slider that can be brought from a first position into a further position, and having a second locking system that also can be brought from a first into a further position and is provided for pulling the connector onto the mating connector and locking it.

BACKGROUND INFORMATION

Many electrical plug connections for connector parts are known.

They serve to ensure an electrical connection between two connector parts, so that unintentional disengagement of that connection is prevented.

A connector, also called a "wiring harness connector," is made up of a connector housing and a cover, and usually has a locking prong. This locking prong is positioned, in the form of a lever, on the side walls of the wiring harness connector, and is to be brought, by pivoting, from a first position (opened position) into a further position (closed position). During placement of the wiring harness connector onto a mating connector, the locking prong engages into two laterally protruding studs, and the wiring harness connector is pulled directly onto the mating connector by downward pressure on the locking prong in the direction of the wiring harness connector. The result is that the electrical plug connection is secured against vibration, i.e. it cannot open or disengage as a result of vibration, shaking motions, or the like.

In further exemplary embodiments of wiring harness connectors of the aforesaid kind, locking sliders are also provided. The locking slider can be brought from an opened into a closed position. To prevent the locking slider from moving or disengaging in response to vibratory stress, or departing from its closed position in any manner whatsoever, at least one latching hook is provided that, when the locking slider is in the closed position, coacts with a latch opening on the wiring harness connector. A displacement of the locking slider toward the closed position causes latching hooks positioned on the mating connector to slide onto a surface of the locking slider until they snap into place in a defined position.

In further exemplary embodiments, provision is made for positioning locking sliders as well as locking prongs together on one electrical plug connection. The locking slider has the function of positioning the wiring harness connector on the mating connector in correctly located and positioned fashion, and the locking lever or locking prong is provided in order to secure the wiring harness connector immovably on the mating connector.

One exemplary embodiment provides that the locking prong cannot be pivoted until the locking slider has already reached its closed position.

A substantial disadvantage of the electrical plug connections disclosed by the existing art is the fact that they are made up of a very large number of parts, so that on the one hand relatively high costs occur, and on the other hand a greater assembly outlay must also be provided.

In addition, electrical plug connections of the aforesaid kind have only a single cable outlet, so that if the cable needs to be guided in a different direction, it must first be guided around the plug connection. The space necessary for this is generally not available.

SUMMARY OF THE INVENTION

It is thus the object of the invention to configure an electrical plug connection having two locking elements—a locking slider and a locking lever—in such a way that reliable operation is obtained in both the closed and the opened position; and so that costs for the manufacture of an electrical plug connection of this kind, as well as the assembly outlay, are reduced.

According to the present invention, it is therefore provided that the cover and the second locking system form one integral part; and that a further cable outlet be present on the connector housing.

A substantial advantage of the apparatus according to the present invention is the fact that manufacturing costs, especially those for the wiring harness connector, are reduced because only one part can be placed onto the connector housing, thereby resulting not only in a reduction in parts count but also in reduced assembly.

The configuration according to the present invention, in particular the locking system by displacement of the cover, additionally allows cable outlets to be provided on both end faces of the wiring harness connector without interfering with the locking system per se.

In addition, the overall installation height of an electrical plug connection of this kind can be made smaller because the usual lever configuration—which in the open position, i.e. during placement of the wiring harness connector onto the mating connector, faces away from the upper part of the wiring harness connector and also requires space for its pivoting motion—is omitted. A simple displacement of the cover perpendicular to the insertion direction achieves the same effect that otherwise is achieved with a lever preferably made of metal.

A further important advantage of the invention consists in the fact that a further cable outlet is present in addition to a cables outlet previously known from the existing art. It is thereby possible to implement cable inlets and outlets on both end faces of a plug connection. This proves advantageous in particular when using connectors that have one contact strip having a plurality of contact elements.

The plug connection according to the invention moreover has a very high level of vibration resistance, and furthermore is of watertight configuration according to standards IPX4K and IPX9K.

DETAILED DESCRIPTION

Figure 1:
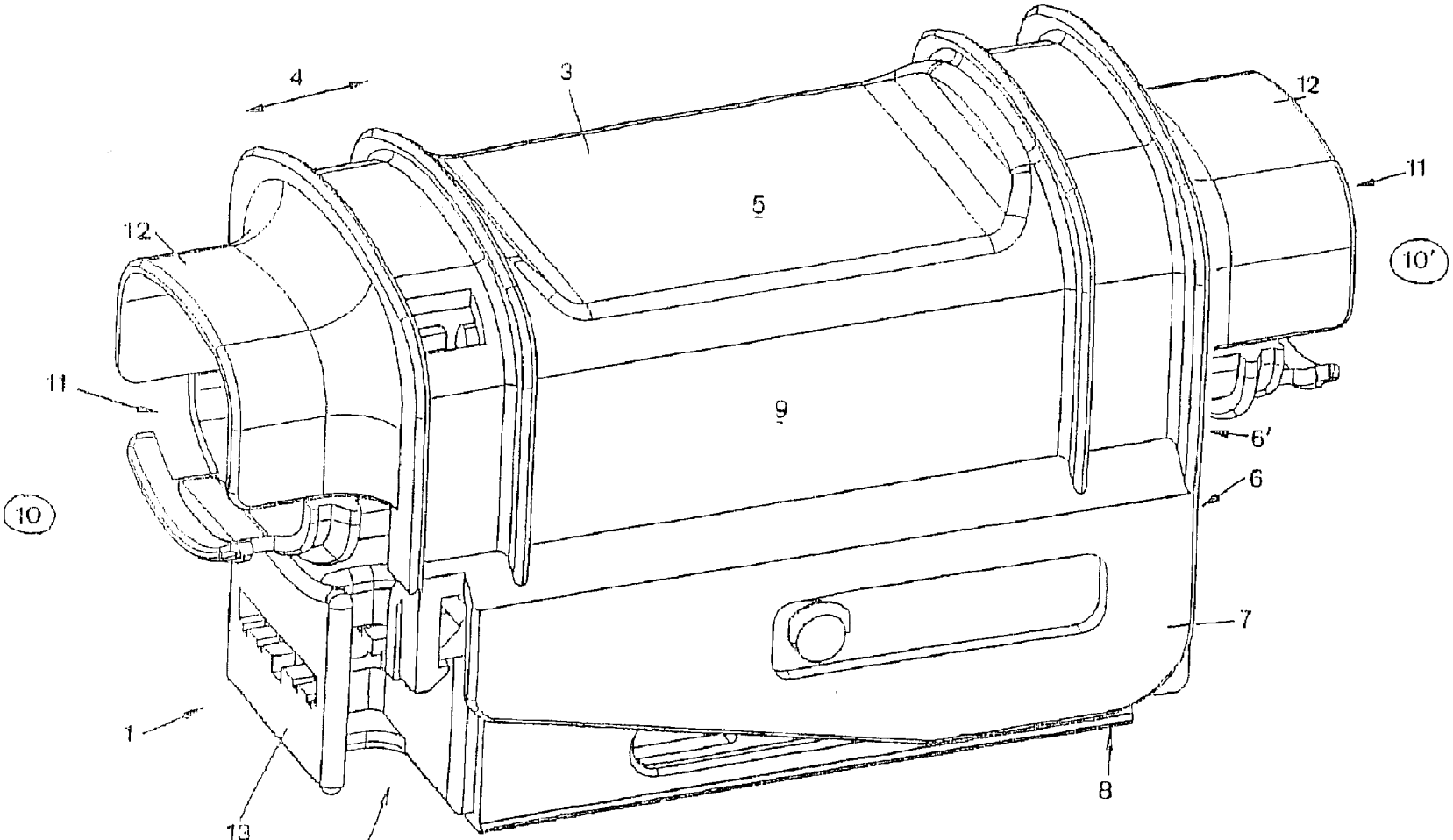
FIG. 1 is a perspective view of the connector according to the present invention of the electrical plug connection, in the locked position.
Figure 2:
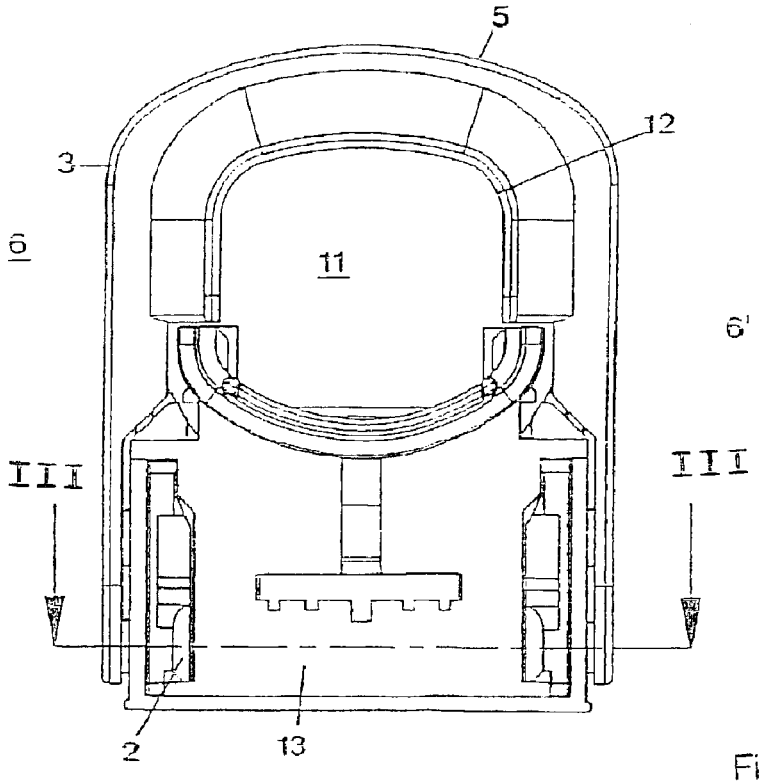
FIG. 2 is an end-on view of the connector shown in FIG. 1.
Figure 3:
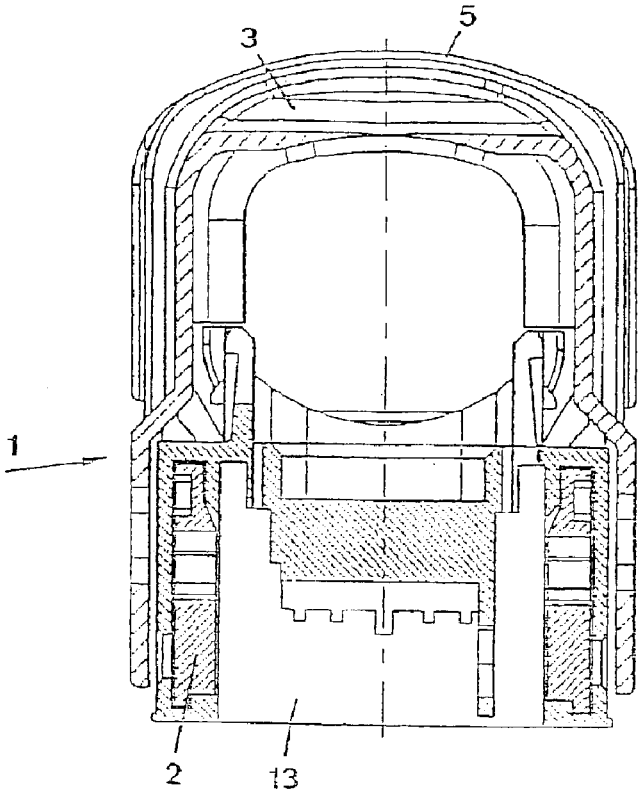
FIG. 3 is a section through the connector according to the present invention along a line II—II in FIG. 2.

FIG. 1 is a perspective view of connector 1 according to the present invention. This connector 1 according to the present invention is made up of a connector housing 2 and a cover 3 positioned on the connector housing 2. Cover 3 is mounted on connector housing 2 displaceably both in and opposite to arrow direction 4, and can assume positions I–III depicted in FIGS. 4–6.

Cover 3 covers connector 1 on its upper surface 5 (cover surface), and extends on both of its longitudinal sides 6, 6' in such a way that cheekpieces 7 extend away from cover surface 5 as far as side 8 located opposite cover surface 5. Gripping surfaces 9 are also provided on cheekpieces 7; these are designed in such a way that, for example, a hand surface can rest on cover surface 5 and the thumb and index finger can rest on gripping surfaces 9. Provided on each of the two end faces 10, 10' is a cable outlet 11 from which cable sections (not depicted in further detail in the drawings) can emerge. The cable sections are protected from kinking or other damage by guide elements 12.

Also provided on connector 1 is a further locking element that is configured in the form of a slider 13. This slider 13 is mounted displaceably in connector housing 2 and is also displaceable in the direction of arrow 4 and in the direction opposite thereto.

Slider 13 is moreover coupled to cover 3 in such a way that either firstly slider 13 is displaceable into its position depicted in FIG. 1 and then cover 3 into its position depicted in FIG. 1, or both, i.e. slider 13 and cover 3, are displaceable together into the closed position depicted in FIG. 1.

Figure 4:
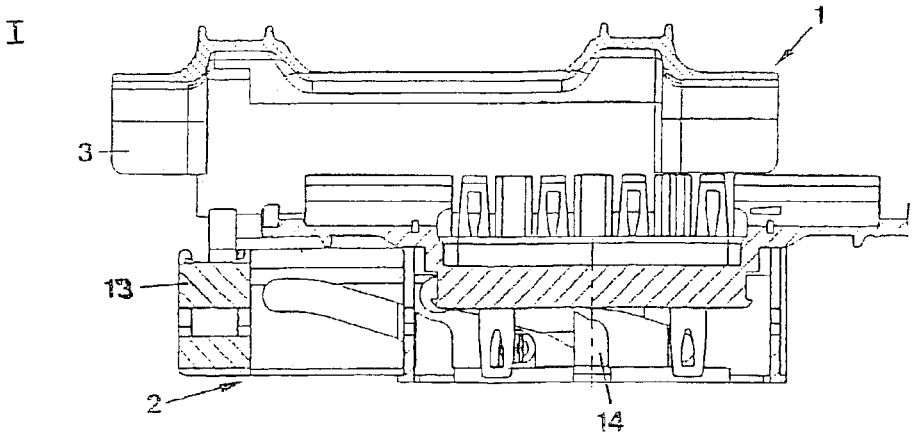
FIG. 4 is a side view of the connector according to the present invention as shown in FIG. 1, partially in section, in the opened position (first locking element open, second locking element open).

For placement of connector 1 onto a mating connector (not depicted in further detail in the drawings), both slider 13 and cover 3 assume position I depicted in FIG. 4. As a result, it is possible for stud elements facing away from the mating connector to engage into openings 14 that are provided on the sides of connector 1. Thus, a second locking system may correspond to openings 14 and connector housing 2, the second locking system arranged for pulling the connector 1 onto the mating connector and for locking it in accordance with relative movement of the connector housing 2 and openings 14 from one position, e.g., an open position, to a further position, e.g., a closed position.

Figure 5:
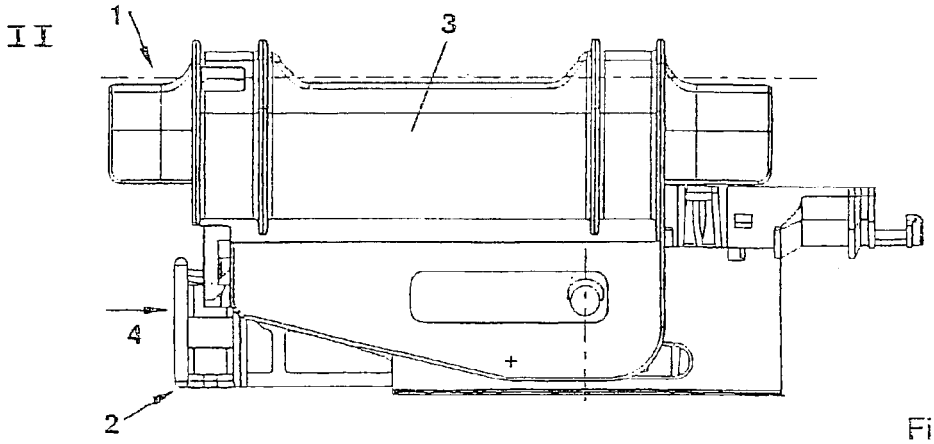
FIG. 5 is a side view of the connector according to the present invention shown in FIG. 1, but (unlike in FIG. 4) with the first locking system (locking slider) closed.

Once connector 1 has been placed on the mating connector and the stud element has engaged into opening 14, slider 13 must be displaced in the direction of arrow 4 as depicted in FIG. 5. Connector 1 is thereby locked to the mating connector (position II).

Figure 6:
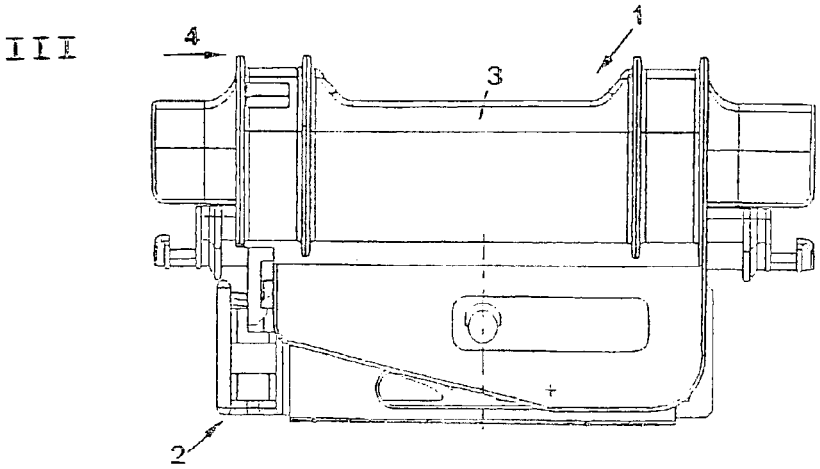
FIG. 6 is a side view of the connector according to the present invention as shown in FIG. 1, but in the closed position with no depiction of the mating connector.

By displacement of cover 3 once again in the direction of arrow 4, as depicted in FIG. 6, connector 1 is pushed onto the mating connector so that an immovable joint that withstands even vibratory stresses is created between connector 1 and the mating connector. The operation of cover 3 and of the locking element is not impaired by the positioning of cable outlets 11 on both end faces 10, 10'.

The motions of slider 13 and cover 3 described above can preferably be performed simultaneously, so that only a single displacement is required to produce an electrical plug connection.

As a result in particular of the positioning of cover 3 and its displacement capability, it is possible to create a plug connection forcefully and in very simple fashion, with no need to be concerned that any pivoting levers, pivoting prongs, or the like might become bent and thus correspondingly impaired in terms of their function.

It has also become possible to produce a wiring harness connector according to the present invention very simply and in economical fashion, since only a few parts are needed in order for the so-called primary and second locking operations to be performed.

What is claimed is:

1. An electrical plug connection comprising:

a connector housing;

a connector adapted to be coupled detachably to a mating connector, the connector including a first locking system in the form of a slider capable of being brought from a first position into a second position, the connector further including a second locking system capable of being brought from an open position into a closed position, the second locking system being for pulling the connector onto the mating connector and locking it;

a cover, the cover and the second locking system forming one integral part; and at least one further cable outlet situated on the connector housing;

wherein the at least one further cable outlet includes two cable outlets situated each on one end face of the connector.

2. The electrical plug connection according to claim 1, wherein the cover is mounted displaceably on the connector.

3. The electrical plug connection according to claim 2, wherein the displacement of the cover occurs perpendicular to a direction of coupling between the connector and the mating connector.

4. An electrical plug connection comprising:

a connector housing;

a connector adapted to be coupled detachably to a mating connector, the connector including a first locking system in the form of a slider capable of being brought from a first position into a second position, the connector further including a second locking system capable of being brought from an open position into a closed position, the second locking system being for pulling the connector onto the mating connector and locking it;

a cover, the cover and the second locking system forming one integral part;

at least one further cable outlet situated on the connector housing; and guide elements that form one integral part with the cover and are situated on the at least one further cable outlet.

5. The electrical plug connection according to claim 4, wherein the cover is mounted displaceably on the connector.

6. The electrical plug connection according to claim 5, wherein the displacement of the cover occurs perpendicular to a direction of coupling between the connector and the mating connector.

* * * * *